United States Patent [19]

Karol

[11] Patent Number: 4,577,729

[45] Date of Patent: Mar. 25, 1986

[54] GUIDE RAIL CLAMPING ASSEMBLY

[75] Inventor: Herman S. Karol, Bricktown, N.J.

[73] Assignee: Westinghouse Electric Corp., Pittsburgh, Pa.

[21] Appl. No.: 678,522

[22] Filed: Dec. 5, 1984

[51] Int. Cl.[4] ..... B66B 7/02

[52] U.S. Cl. ..... 187/95; 248/228

[58] Field of Search ..... 187/95; 238/331, 281, 238/282; 248/228, 229; 24/514, 573, 580, 511

[56] References Cited

U.S. PATENT DOCUMENTS

| | | | |
|---|---|---|---|
| 1,505,245 | 8/1924 | Christmas | 238/331 X |
| 2,321,106 | 6/1943 | Sanford | 187/95 |
| 3,199,642 | 8/1965 | Anderson | 187/95 X |
| 3,826,423 | 7/1974 | McClung | 238/282 X |
| 3,904,113 | 9/1975 | Molyneux | 238/281 X |
| 3,923,245 | 12/1975 | Marchant | 238/331 X |
| 4,431,087 | 2/1984 | Karol | 187/95 |

*Primary Examiner*—F. J. Bartuska

*Assistant Examiner*—Nils E. Pedersen

*Attorney, Agent, or Firm*—D. R. Lackey

[57] ABSTRACT

A guide rail clamping assembly for elevator guide rails in which an intermediate mounting member having tapped openings and bolts attach rail clips to the guide rails, while thereafter permitting this whole assembly to be positionally adjusted as a unit. The bolts extend through openings in still another mounting member, and nuts engage the bolts to fix the unit to the associated building once it is correctly positioned. Each rail clip has first and second ends, with the first end being adapted to overlap a flange of the guide rail. An elongated opening extends between the ends of each rail clip, and the second end defines a notch. The intermediate mounting member has first and second ends, each of which defines a projection which is adapted to successively cooperate with an elongated slot during assembly of the guide rail, and with the notch during the clamping of the rail clip to the guide rail flange.

5 Claims, 10 Drawing Figures

GUIDE RAIL CLAMPING ASSEMBLY

BACKGROUND OF THE INVENTION

1. Field of the Invention

The invention relates in general to guide rails, and more specifically to new and improved guide rail clamping apparatus for attaching and accurately positioning elevator guide rails in a hatchway or hoistway of a building.

2. Description of the Prior Art

The movable elements of an elevator system, such as the elevator car and its counterweight, are guided throughout their respective travel paths in the hoistway of a building. The guiding system conventionally includes guide rails, which have a substantially T-shaped cross-sectional configuration, which rails are fixed in the hoistway, and guide elements, such as guide roller assemblies, with the guide elements being carried by the elevator car and counterweight. The guide elements coact with three guide surfaces on each of the guide rails to guide the movable elements.

When an elevator system is installed, extreme care must be taken to properly align the sections which make up each complete guide rail, to properly locate each group of aligned sections between the front and back walls of the hoistway, called the "fore-aft" axis, and to accurately space the two groups of aligned sections, called the "between guides" or B.G. axis.

The conventional T-shaped guide rail includes first and second flanges and a stem. The stem defines the three guide surfaces, one on the nose or face of the stem portion, and one on each side of the opposed surfaces of the stem.

My U.S. Pat. No. 4,431,087 discloses and claims a new and improved guide rail clamping assembly which facilitates making both the fore-aft and B.G. adjustments, all without releasing the rail clips from the guide rails. This clamping apparatus includes a first mounting member, also called a rail bracket, which is fixed to the building, a second mounting member, also referred to as an intermediate support member, first and second rail clip members, first and second bolts, and first and second nuts. The first and second bolts extend through openings in the first and second rail clip members, and threadably engage tapped openings in the second mounting member. The first and second bolts are tightened to firmly clamp the guide rail flanges between the second mounting member and the first and second rail clip members, which overlap the first and second flanges, respectively, of the guide rail. This forms a first or intermediate assembly which can be shimmed as a unit to the correct B.G. and "tapped" to the fore-aft plumb line.

The first and second bolts continue through elongated openings in the first mounting member, and the first and second nuts are loosely assembled on the bolts while the first assembly is being positioned. The nuts are then tightened on the first and second bolts, respectively, to firmly clamp the first assembly to the first mounting member, and thus to the associated building.

SUMMARY OF THE INVENTION

Briefly, the present invention improves upon the clamping assembly of my U.S. patent by providing a rail clip having first and second ends, an opening elongated in a direction between the ends, and a notch in the second end. The second mounting member also has first and second ends, each of which defines a projection which cooperates with the elongated opening and notch of a rail clip. When a guide rail is being positioned on the second mounting member the rail clips should not interfere, and they should not be bent or otherwise damaged. At this point in time, the projections on the second mounting member extend into the elongated openings of the rail clips, enabling the rail clips to be moved laterally out of the way without skewing or rotating on the associated bolt. In other words, the projection and bolt, both being disposed in the elongated slot, enable the rail clip to be moved horizontally while maintaining the correct orientation for subsequent engagement with the guide rail. After the guide rail is positioned against the second mounting member, the clips are moved laterally to cause their first ends to extend over the flanges of the guide rail, and the bolts are loosened just enough to enable the projections on the second mounting member to now engage the notches in the second ends of the rail clips.

BRIEF DESCRIPTION OF THE DRAWINGS

The invention may be better understood, and further advantages and uses thereof more readily apparent, when considered in view of the following detailed description of the exemplary embodiments, taken with the accompanying drawings in which.

DESCRIPTION OF THE PREFERRED EMBODIMENTS

Figure 1:
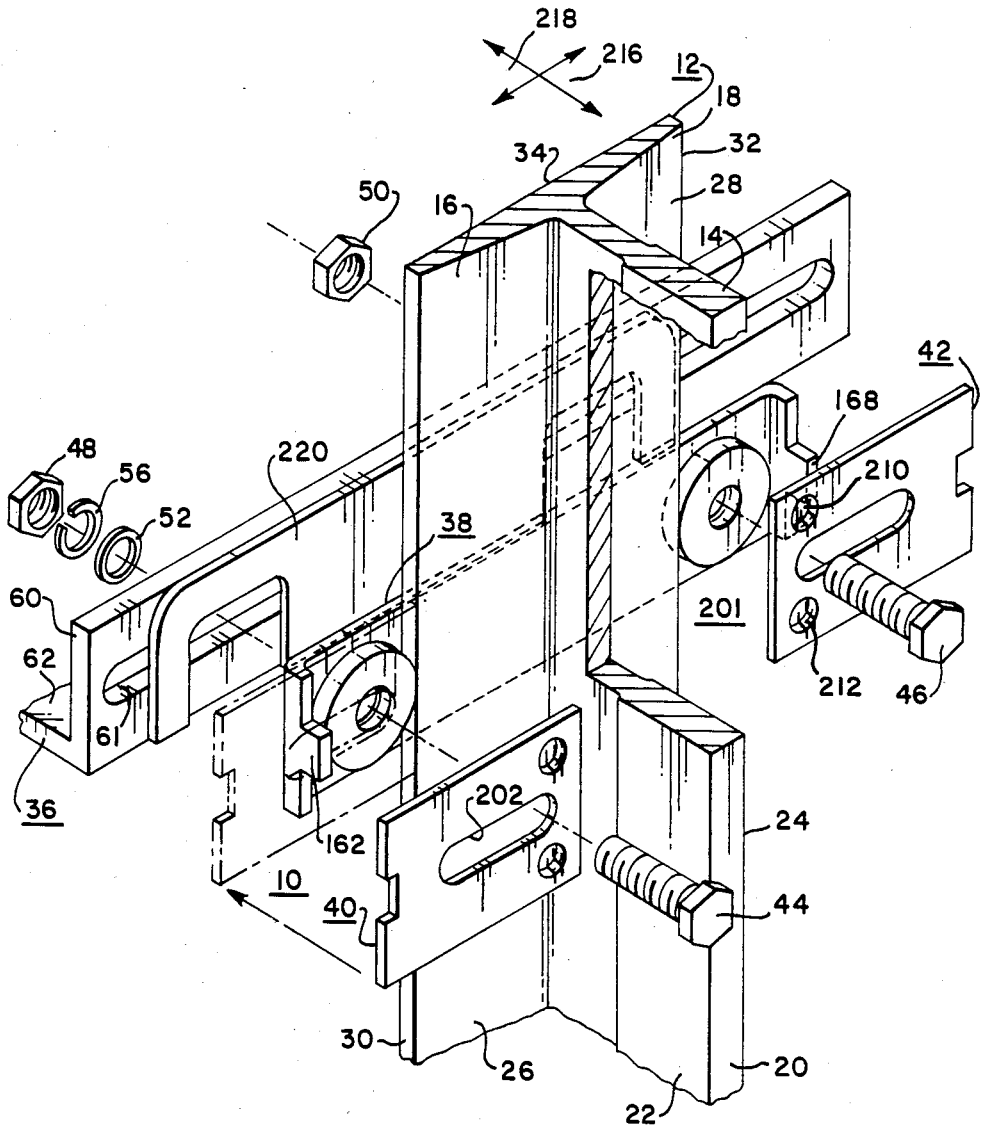
FIG. 1 is an exploded perspective view of a guide rail clamping assembly constructed according to the teachings of the invention, with the rail clips being shown in a retracted position.
Figure 2:
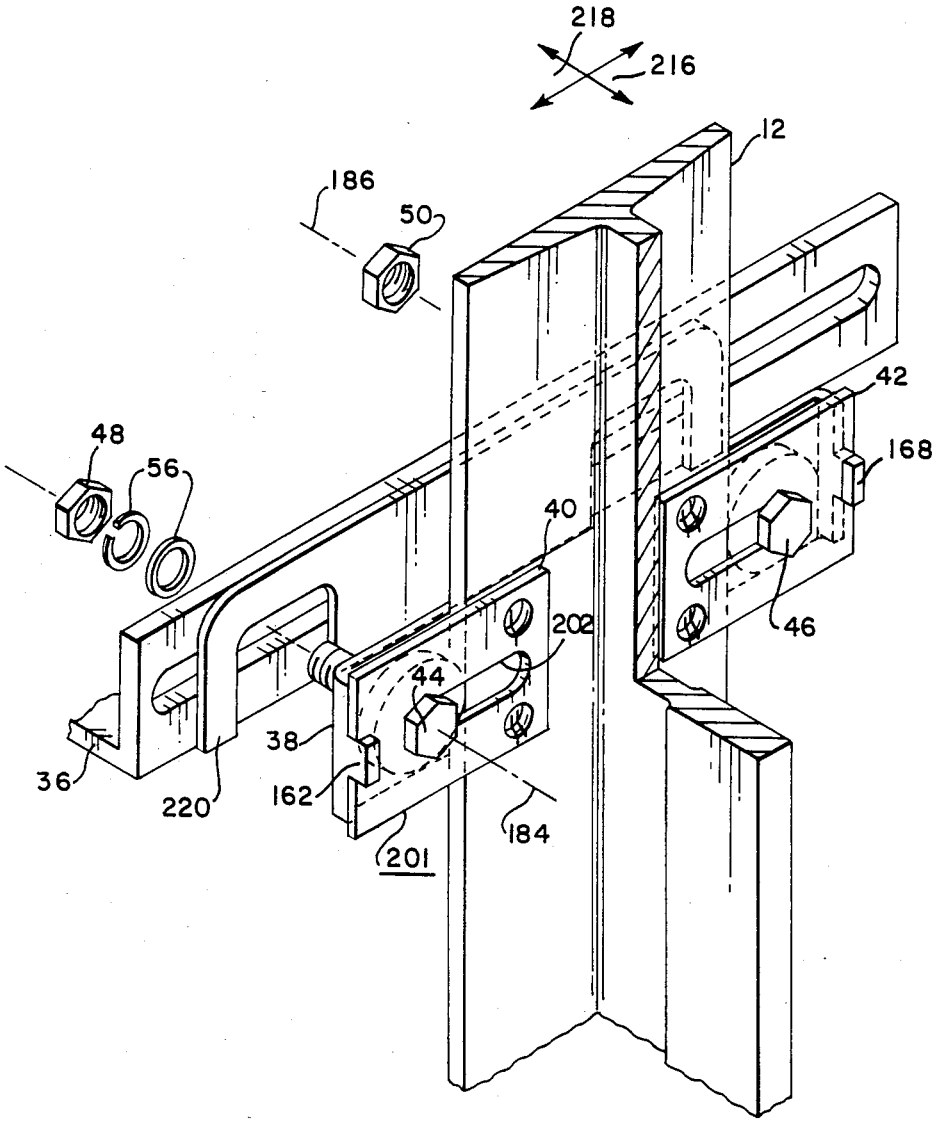
FIG. 2 is a view similar to FIG. 1, except illustrating the rail clamps in an operative advanced position.

Referring now to the drawings, FIGS. 1 and 2 set forth a guide rail clamping assembly 10 constructed according to the teachings of the invention. FIGS. 1 and 2 are partially exploded, perspective views of guide rail clamping assembly 10, with the rail clips being respectively shown in retracted and advanced positions.

More specifically, guide rail clamping assembly 10 is for use with a guide rail 12 which has a substantially T-shaped cross-sectional configuration. Guide rail 12 includes a stem portion 14 and first and second flanges 16 and 18, respectively, disposed on opposite sides of the stem portion 14. The stem portion 14 includes a nose or face guide surface 20, and first and second opposed side guide surfaces 22 and 24, respectively. The first and second flanges include first and second front surfaces 26 and 28, respectively, first and second side or lateral edges 30 and 32, respectively, and back portions which lie in a common plane and are thus referenced with a single reference 34.

The elements of the clamping assembly 10 which perform the function of securing guide rail 12 in a building hatchway include a first mounting member 36, conventionally referred to as a rail bracket, a second mounting member 38, which may also be referred to as an intermediate support member, first and second rail clip members 40 and 42, respectively, first and second bolts 44 and 46, respectively, and first and second nuts 48 and 50, respectively. Additional fastener hardware may be used, such as washers and lock washers, with a washer 52 and lock washer 56 being shown associated with bolt 44.

The rail bracket 36, which may be a right angle metallic member, as shown in FIGS. 1 and 2, or a channel-shaped member, includes a vertically oriented leg portion 60 for connection to the guide rail 12, and a horizontally oriented leg portion 62 for connection to a support structure. The support structure is part of the associated building. At least one elongated opening or slot 61 is provided in leg 60. In a preferred embodiment of the invention, first and second elongated slots or openings are provided, but one long slot may be provided, as desired.

Up to this point, the description of the elements of clamping assembly 10 has been substantially the same as in my hereinbefore mentioned U.S. Pat. No. 4,431,087, and this patent is hereby incorporated into the specification of the present application by reference.

Figure 5:
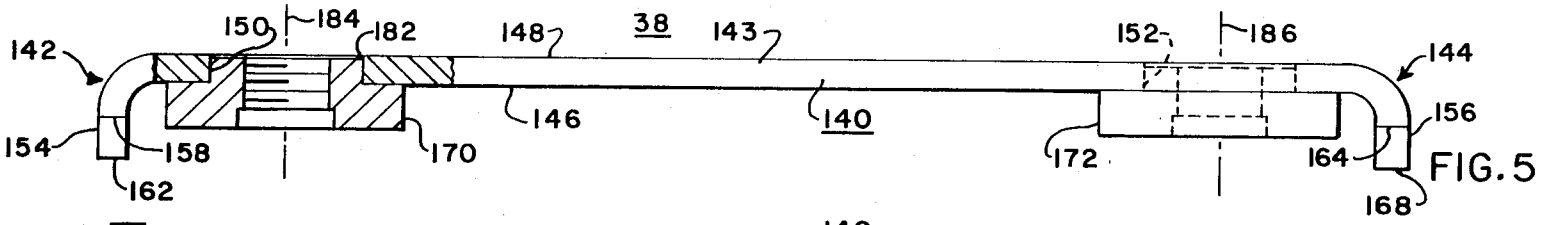
FIG. 5 is a top view of the intermediate mounting member shown in FIG. 3.
Figure 3:
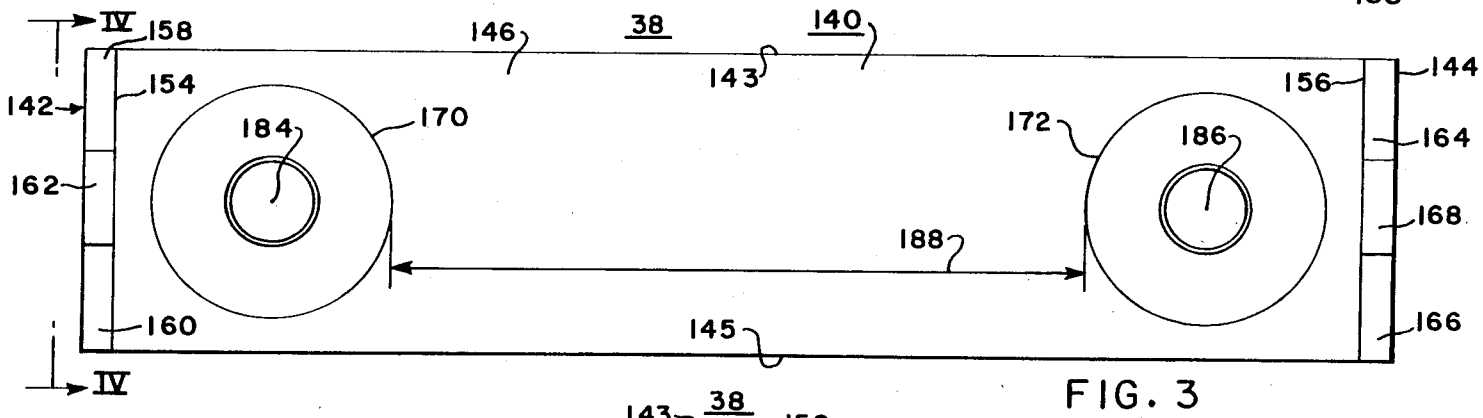
FIG. 3 is a plan view of an intermediate mounting member constructed according to the teachings of the invention.
Figure 4:
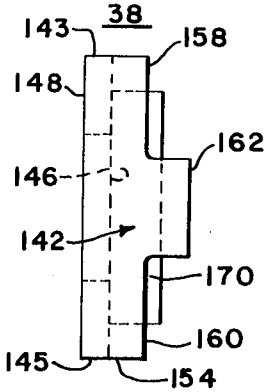
FIG. 4 is an end view of the intermediate mounting member shown in FIG. 3.
Figure 7:
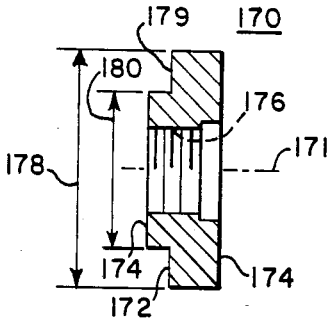
FIG. 7 is a side view of the cylindrical spacer button shown in FIG. 6.
Figure 6:
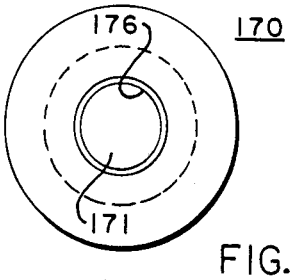
FIG. 6 is a plan view of a cylindrical spacer button used in the construction of the intermediate mounting member shown in FIGS. 3, 4 and 5.

The intermediate support member 38 is constructed according to the teachings of the present invention, and it is shown in detail in FIGS. 3, 4, 5, 6 and 7. FIGS. 3, 4 and 5 are plan, end and top views, respectively, of the intermediate support member 38.

More specifically, the intermediate support member 38 includes an elongated steel plate 140 having first and second ends 142 and 144, respectively, upper and lower edges 143 and 145, respectively, and first and second flat, major opposed parallel surfaces 146 and 148. First and second spaced openings 150 and 152, respectively, extend between its major surfaces 146 and 148, with the first opening 150 being adjacent to the first end 142, and the second opening 152 being adjacent to the second end 144.

The first and second ends 142 and 144 are bent to form first and second relatively short leg portions 154 and 156, respectively, which extend perpendicularly outward from major surface 146. The extreme ends of leg portions 154 and 156 are each cut to provide shoulder portions adjacent to the upper and lower edges 143 and 145, which terminate at centrally located projecting portions. For example, leg portion 154 includes upper and lower shoulder portions 158 and 160, respectively, which terminate at projection 162, and leg portion 156 includes upper and lower shoulder portions 164 and 166, respectively, which terminate at projection 168.

First and second metallic spacer members or spacer buttons 170 and 172, respectively, are fixed to plate 140. Since the spacer buttons are all of like construction, only spacer button 170 will be described in detail. Spacer member 170 is shown in plan and side views in FIGS. 6 and 7, respectively.

Spacer button 170 is cylindrical in configuration, with reference to axis 171. Button 170 has first and second axial ends 172 and 174, respectively, and a tapped opening 176 which extends between its axial ends. Tapped opening 176 is sized to threadably receive bolt 44. Spacer member 172 has a first outside diameter 178 adjacent to its first end which steps inwardly at shoulder 179 near the second end 174, to define a smaller second outside diameter 180. The second outside diameter 180 is selected to snugly enter opening 150 in plate 140, with shoulder 179 resting against surface 146 of plate 140. End 174 may be tack welded to plate 140, such as illustrated at 182 in FIG. 5. The spacing between the center lines 184 and 186 of openings 150 and 152, respectively, in plate 140, and the first diameter 178 of the spacer buttons is selected to provide the spacing 188 (FIG. 3) between the spacer buttons which will snugly but slidably accept the width dimension across the back 34 of the guide rail 12.

Figure 9:
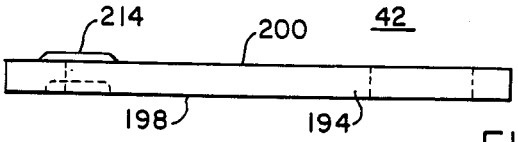
FIG. 9 is a top view of the rail clip shown in FIG. 8.
Figure 8:
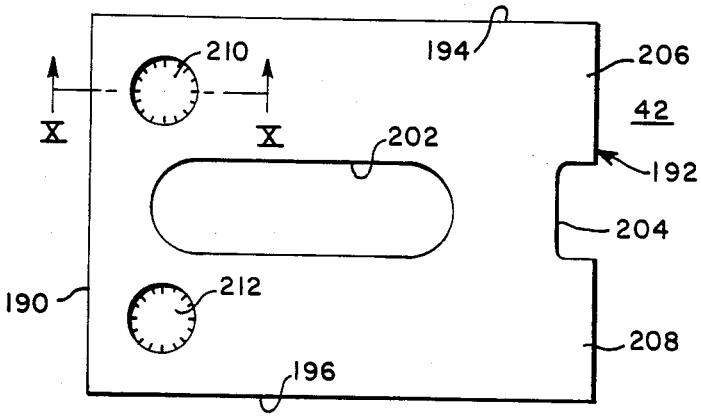
FIG. 8 is a plan view of a rail clip constructed according to the teachings of the invention.
Figure 10:
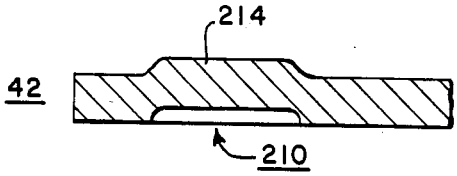
FIG. 10 is a cross sectional view of a portion of the rail clip shown in FIG. 8, taken between and in the direction of arrows X—X.

The first and second rail clip members 40 and 42 are formed of a suitable metal, such as 304 stainless steel. Since the rail clip members are of like construction, only the rail clip member 42 will be described in detail. Rail clip 42 is shown in FIGS. 8, 9 and 10, with FIGS. 8 and 9 being plan and top views, respectively, and with FIG. 10 being a cross-sectional view of FIG. 8, taken between and in the direction of arrows X—X.

Rail clip 42 has first and second ends 190 and 192, respectively, upper and lower edges 194 and 196, respectively, and first and second flat major opposed surfaces 198 and 200, respectively.

An opening 202 extends between surfaces 198 and 200, with opening 202 being elongated in a direction between ends 190 and 192. A notch 204 is formed in the second end 192, with the notch 204 being defined by upper and lower spaced projections 206 and 208, respectively. Rail clip 42 is extruded at locations 210 and 212, adjacent to the first end 190, to provide spaced projections, such as projection 214, from the second major surface 200. These space projections contact flange 28 of the guide rail 12, when the rail clip is in its operative position. FIG. 10 is a cross-section view of FIG. 8, taken through the extrusion 210.

In the assembly of the various elements of the guide rail clamping assembly 10, the rail brackets 36 are fixed to the building using a plumb line to orient the centers of the rail brackets. The upper surface of leg 60 may be suitably grooved in order to aid in the locating process. Rail clips 40 and 42 are attached to an intermediate support member 38 by engaging bolts 44 and 46 with the tapped openings 176. The projections 162 and 168 of the intermediate support member 38 are disposed in slots 202 of the associated rail clips, and the rail clips are moved to the retracted position shown in FIG. 1. This provides room for the guide rail 12 to be entered between the spacer buttons 170 and 172.

The assembly 201 of member 38, bolts 44 and 46, and clips 40 and 42 may be preassembled to bracket 36, with the clips retracted. After the rail flange is placed between buttons 170 and 172, clips 40 and 42 are pushed forward to engage the rail flanges. Alternatively, the intermediate support member and clips may be first applied to the rails in the pit. This permits the intermediate support member 38 and its clips to be pushed along the associated rail section, without danger of skewing the clips, to the location of a rail bracket 36, once the rail sections are in the proper position in the hatchway.

As the rail clips are advanced to their clamping positions shown in FIG. 2, the projections 162 and 168 at the ends of the intermediate support member 38 are inserted into the notches 204 at the second ends of the associated rail clips. The bolts 44 and 46 may now be firmly tightened to cause the extrusions 210 and 212 on the rail clips 40 and 42 to press against the flanges 26 and 28 and produce a flex in the rail clip which applies a resilient spring pressure against the guide rail. The resulting resilient clamping pressure while firm, enables the guide rail to slip with the settling of the building, to thus prevent distortion of the guide rail. The shoulders, notches, and projections all cooperate to maintain the correct orientation of the rail clips, during any settling of the building.

Bolts 44 and 46 are selected to have a length dimension sufficient to extend outwardly past surface 148 of the intermediate support member 38, and through the elongated openings of the rail bracket 36.

The tightening of the bolts 44 and 46 completes a first clamping function associated with the bolts, resulting in a first unitary assembly 201 which includes the guide rail section 12 being firmly clamped between the intermediate support member 38 and the rail clips 40 and 42. The bolts 44 and 46, being accurately spaced, form two solid, immovable, post-like projections which extend through the adjustment slots of the rail bracket 36.

Guide rail section 12 is adjusted along the fore-aft axis, indicated at 216, to the proper location, which may be established by a plumb line. The second critical adjustment of the guide rail 12 is the spacing between the nose 20 of guide rail section 12 and the nose of a guide rail section located on the other side of the hatchway. This is the B.G. dimension indicated by axis 218 in FIG. 1. The proper location of nose 20 which will provide the proper B.G. dimension may also be established by the plumb line. The unitary assembly 201 is free to move in either the fore-aft axis 216, or the B.G. axis 218, without adversely affecting the rail clip to guide rail contact. The washers, lock washers, and nuts 48 and 50 may now be assembled with bolts 44 and 46, with the nuts being untightened at this point in time. The nose 20 of the guide rail section 12 is shimmed to the plumb line using one or more shims, such as shim 220. After the nose 20 of the guide rail section 12 has been shimmed to the plumb line, the assembly 201 may now be adjusted in the direction of the fore-aft axis 216 to place the center of the nose 20 on the plumb line, and the nuts are then tightened to final torque, to firmly clamp assembly 201 to the guide rail bracket 36. This clamping function of bolts 44 and 46, which is independent of the first clamping function, thus holds the guide rail section 12 in the precise fore-aft and B.G. locations.

In summary, the present invention permits the rail clips 40 and 42 to be horizontally retracted to provide room for receiving the guide rail 12 between the spacer buttons, without any possibility of the rail clips rotating about their respective bolt. The same projections which permit the retraction function engage the notches at the back of the clips when the clips are moved forward to engage the guide rail, to allow the bolts to be tightened without clip rotation, and/or retraction from the rail surfaces 16 and 18, as well as to thereafter maintain the desired rail clip alignment, even during settling of the building.

I claim as my invention:

1. In a guide rail clamping assembly for fixing rail clips to an elevator guide rail while facilitating both fore-aft and between guide (B.G.) adjustment of the guide rail relative to a support structure, including a first mounting member adapted to be fastened to the support structure and which defines an elongated opening, a second mounting member adjacent to the first mounting member having first and second tapped openings aligned with the elongated opening of the first mounting member, first and second rail clip members for engaging the flanges of a guide rail, with each rail clip member having first and second ends, and an opening intermediate its ends aligned with a tapped opening of the second mounting member, first and second bolts extending through the openings in the first and second rail clip members, respectively, and engaging the first and second tapped openings, respectively, in the second mounting member, to enable the flanges of the guide rail to be tightly clamped and locked by the first ends of the rail clips against the second mounting member, with the first and second bolts further extending through the elongated opening in the first mounting member, permitting fore-aft and B.G. adjustment of the guide rail section relative to the first mounting member without releasing said lock, and first and second nuts on the first and second bolts, respectively, for clamping the rail clip members, second mounting member and associated guide rail to the first mounting member, the improvement comprising:

said opening in each of the first and second rail clip members being elongated in a direction between its ends to enable lateral movement of each rail clip relative to its associated bolt for receiving a guide rail, and including a notch in the second end of each rail clip, and first and second projections on the second mounting member, said first and second projections being adapted to extend into the elongated openings of the first and second rail clips, respectively, to orient, laterally guide and prevent rotation of the associated rail clip while it is being moved to receive a guide rail, said first and second projections extending into the notches at the second ends of the first and second rail clips, respectively, to orient and prevent rotation and retraction of the rail clips when they are in their clamping position relative to a guide rail.

2. In the guide rail clamping assembly of claim 1 wherein the second mounting member includes an elongated metallic plate having first and second ends, with the first and second ends being bent to define the first and second projections, respectively.

3. In the guide rail clamping assembly of claim 1 wherein the second mounting member includes a metallic plate having first and second spaced openings therein, and first and second cylindrical button members, each of said button members having first and second ends, a first outside diameter adjacent to its first end which is disposed in an opening in the metallic plate, a second outside diameter, larger than the first, adjacent to the second end, and an opening which extends between its ends, with said opening in the cylindrical button member being tapped to provide one of the tapped openings of the second mounting member.

4. In the guide rail clamping assembly of claim 3 wherein the dimension between the spaced openings, and the second diameter of the cylindrical button members are selected such that a dimension between the second diameters of the cylindrical button members snugly receives a guide rail.

5. In the guide rail clamping assembly of claim 1 wherein each of the first and second rail clip members includes a flat metallic plate, and including first and second spaced projections integral with said plate adjacent to its first end for contacting a flange on a guide rail.

* * * * *